US011553737B1

(12) United States Patent
Hong

(10) Patent No.: US 11,553,737 B1
(45) Date of Patent: Jan. 17, 2023

(54) UNDERWEAR FOR MALE

(71) Applicant: Lianpao Hong, Fujian (CN)

(72) Inventor: Lianpao Hong, Fujian (CN)

( * ) Notice: Subject to any disclaimer, the term of this patent is extended or adjusted under 35 U.S.C. 154(b) by 0 days.

(21) Appl. No.: 17/723,838

(22) Filed: Apr. 19, 2022

(30) Foreign Application Priority Data

Mar. 11, 2022 (CN) ..... 202220535828.7
Mar. 24, 2022 (CN) ..... 202220657047.5

(51) Int. Cl.
*A41B 9/00* (2006.01)

(52) U.S. Cl.
CPC ..... *A41B 9/004* (2013.01)

(58) Field of Classification Search
CPC ..... A41B 9/004
USPC ..... 2/400, 403
See application file for complete search history.

(56) References Cited

U.S. PATENT DOCUMENTS 5,283,912 A * 2/1994 Chung ..... A41B 9/023 2/403
5,461,729 A * 10/1995 Brocks ..... A41B 9/02 2/403
7,827,623 B2 * 11/2010 Kurata ..... A41B 9/001 2/400
10,542,782 B2 * 1/2020 Shupe ..... A41B 9/023
2007/0277285 A1 * 12/2007 Gravette ..... A41B 9/023 2/78.1
2021/0259326 A1 * 8/2021 Shaughnessy ..... A41B 9/004

* cited by examiner

*Primary Examiner* — Gloria M Hale
(74) *Attorney, Agent, or Firm* — Cooper Legal Group, LLC

(57) ABSTRACT

The present application relates to an underwear for a male, which belongs to a technical field of clothing. The underwear for the male includes a body, and the body includes a front portion and a back part. The front portion is provided with a genital bag with an opening, and the genital bag is provided at an inner side of the body. A connecting part is provided at the inner side of the body, connected with cloth at an edge of the genital bag, and extends from the front portion to the back part.

12 Claims, 4 Drawing Sheets

UNDERWEAR FOR MALE

CROSS-REFERENCE TO RELATED APPLICATION

This application claims the priority to China patent application serial no. 202220535828.7, filed on Mar. 11, 2022 and China patent application serial no. 202220657047.5, filed on Mar. 24, 2022. The entireties of China patent application serial no. 202220535828.7 and China patent application serial no. 202220657047.5 are hereby incorporated by reference herein and made a part of this specification.

TECHNICAL FIELD

The present application relates to a technical field of clothing, in particular to an underwear for a male.

BACKGROUND ART

An underwear is a kind of pants contacting skin, and includes an underwear for a male and an underwear for a female. At present, a bag is generally provided at the front of the underwear for a male. When wearing, the genital is placed in the bag, so as to avoid a contact between the genitals and the skin on inner thighs and reduce skin friction.

However, when a user is wearing such underwear, the scrotum is easy to fall out of the bag, rendering the wearing uncomfortable.

In view of this, there is still a need to provide a relatively comfortable underwear for a male.

SUMMARY

In order to improve the comfort for wearing, the present application provides an underwear for a male.

The underwear for the male includes a body, and the body includes a front portion and a back portion the front portion is provided with a genital bag with an opening, and the genital bag is provided at an inner side of the body. A connecting part is provided at the inner side of the body. The connecting part is connected at an edge of the genital bag, and the connecting part extends from the front portion to the back portion.

In the above technical solution, the genital bag and the connecting part together wrap a genital, so as to avoid a friction between scrotum skin and skin on an inner thigh, providing a comfortable wearing.

In some embodiments, an end of the connecting part away from the genital bag extends to a joint of the front portion and the back portion.

In some embodiments, a first isolation layer is provided at an inner side of the body, and connected with the front portion. The genital bag includes a first portion and a second portion respectively provided at left and right sides of the first isolation layer. An accommodation pocket 8 for accommodating a genital is formed by the first portion, the second portion and the isolation layer together.

In the above technical solution, by providing the first isolation layer, the underwear has two layers of cloth in front of the genitals. Therefore, wear resistance of underwear can be increased, and the genitals can be well protected, while reducing friction and improving wearing comfort.

In some embodiments, the first portion is integrated with the second portion.

In the above technical solution, integrating the first portion with the second portion can reduce the need of sewing, provide smooth connection, and prevent discomfort due to friction between skin and sewing threads.

In some embodiments, a length of the connecting part is smaller than a fabric length of the body between two ends of the connecting part.

In the above technical solution, due to a length of the connecting part smaller than a fabric length of the body between two ends of the connecting part, when wearing the underwear, the connecting part is tightened with the fabric of the genital bag, so that the fabric at the opening of the genital bag is pulled upward to wrap and support a scrotum, prevent the scrotum from falling out of the genital bag, and avoid a friction between the scrotum skin and the skin on the inner thigh, providing the user with comfortable wearing. Further, the connecting part provides a relatively large gap between the connecting part and the body, which increases air and moisture permeability of the underwear and facilitates keeping the skin dry.

In some embodiments, the length of the connecting part is 0.7-0.95 times the fabric length of the body between two ends of the connecting part.

In the above technical solution, when the length of the connecting part is 0.7-0.95 times the fabric length of the body between the two ends of the connecting part, the underwear can be comfortably worn by an user due to this ergonomic length.

In some embodiments, the connecting part is integrated with the genital bag.

In the above technical solution, integrating the connecting part with the genital bag can reduce the need of sewing, provide a smooth connection, and avoid discomfort caused by the friction between skin and sewing threads.

In some embodiments, the genital bag and/or the connecting part are provided with a plurality of air holes.

In the above technical solution, providing the air holes renders the underwear air permeable.

In some embodiments, the genital bag and/or the connecting part are made of elastic fabric.

In the above technical solution, the elastic fabric can be deformed to conform with a user's body, increasing the extension space of a genital.

In some embodiments, the body further includes a crotch connected with the front portion and the back portion; and an end of the connecting part away from the genital bag extends to the crotch.

In the above technical solution, by providing the crotch, the user can wear the underwear more comfortably. In addition, since the connecting part extends to the joint of the back portion and the crotch, the need of sewing can be reduced, the whole underwear can be made smooth, and uncomfortable wearing due to friction between skin and sewing threads can be avoided.

In some embodiments, an end of the connecting part away from the genital bag extends to a joint of the back portion and the crotch.

In some embodiments, the front portion is provided with a sewing opening, and the first isolation layer is provided at the sewing opening, a first opening is provided between the first isolation layer and the front portion, a second isolation layer is provided at the sewing opening, a second opening is provided between the second isolation layer and the front portion, an outlet passage is provided between the first isolation layer and the second isolation layer, and the accommodation pocket is communicated with outside via the first opening, the second opening and the outlet passage.

By adopting the above technical solution, a user can conveniently urinate by taking out his genital via the first opening, the second opening and the outlet passage.

In some embodiments, the connecting part is integrated with the genital bag. The connecting part extends along a first direction. The first portion and the second portion extend along a second direction which is roughly perpendicular to the first direction, and symmetrically provided at two sides of the connecting part. A notch is provided at a joint of the first portion and the second portion, opposite to the connecting part. Edges of the first layer and the second layer away from the connecting part along the second direction and those away from the connecting part along the first direction are connected with the underwear body after folding the first layer and the second layer away from the connecting part 9 along the first direction and toward the connecting part 9 along the second direction.

In summary, the present application can achieves at least one of the following beneficial technical effects.

1. In the present application, the genital bag wraps the scrotum, the connecting part is tightened with the genital bag, so that the fabric at the opening of the genital bag is pulled upward to wrap and support a scrotum, prevent the scrotum from falling out of the genital bag or injuring or swelling due to a long-term friction between the scrotum skin and the skin on the inner thigh, providing the user with comfortable wearing.

2. In the present application, the connecting part is integrated with the genital bag, which reduces the need of sewing, renders the underwear smooth, and prevents uncomfortable wearing due to the friction between skin and sewing threads.

DETAILED DESCRIPTION

The present application will be further described in details in connection with FIGS. 1-4.

Figure 1:
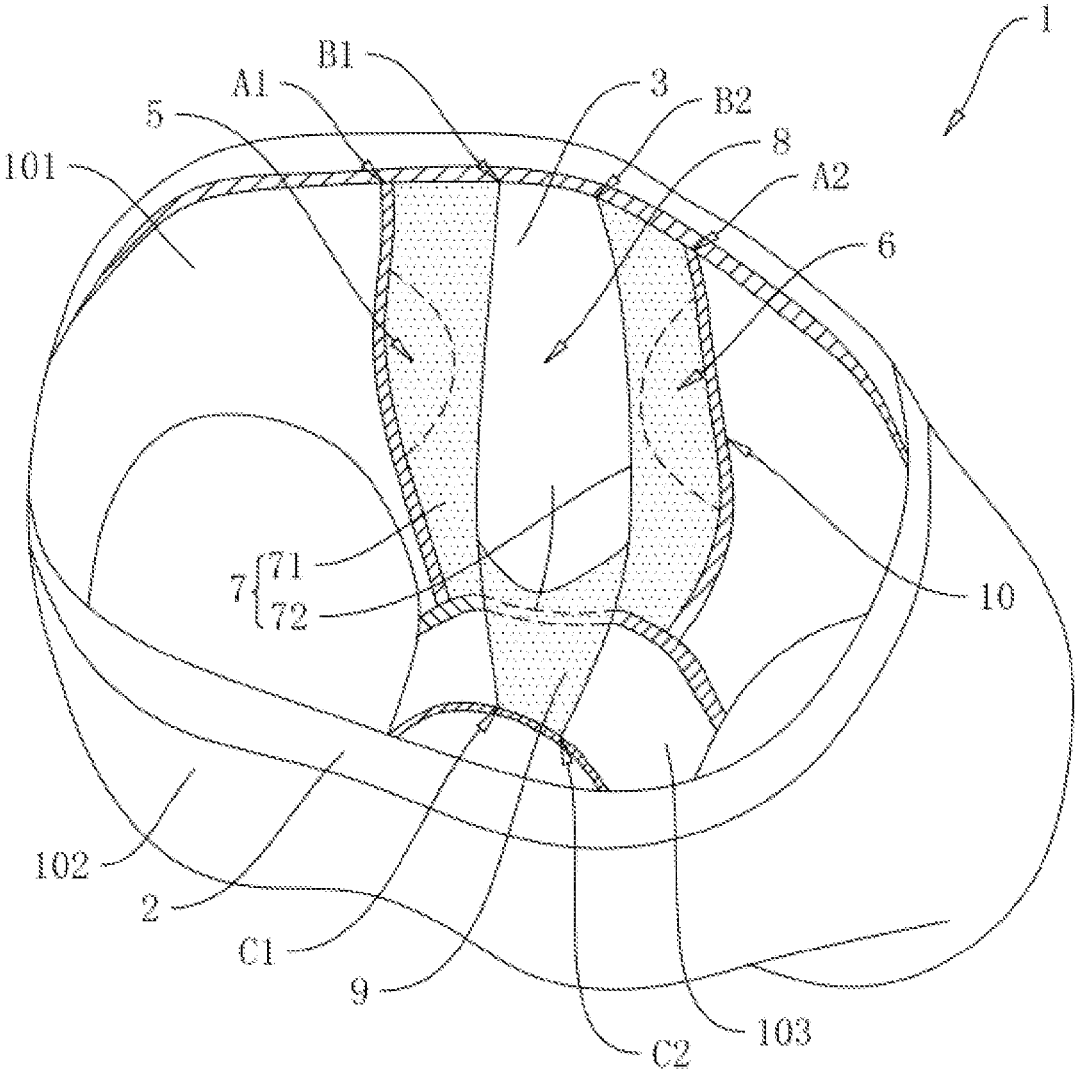
FIG. 1 is an overall structural diagram of an underwear for a male according to an embodiment of the present application.

Referring to FIG. 1, an underwear for a male is provided in an embodiment of the present application. The underwear for the male is a boxer brief, which includes a body 1 and a waist 2. The waist 2 is sewn at an upper edge of the body 1. The body 1 includes a front portion 101, a back portion 102 and a crotch 103. Left and right sides of the front portion 101 are sewn with left and right sides of the back portion 102, respectively, and bottom edges of the front portion 101 and the back portion 102 are sewn with two edges of the crotch 103, respectively.

Figure 2:
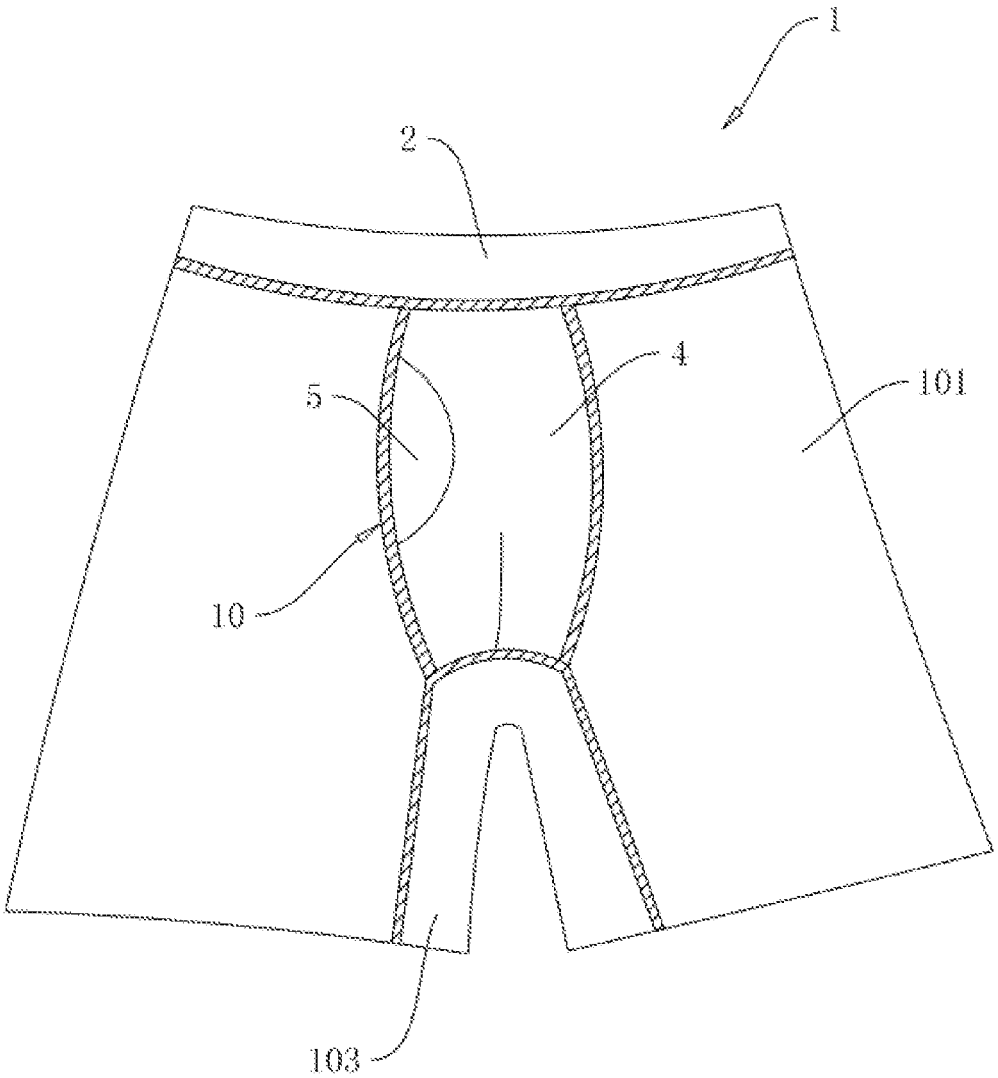
FIG. 2 is a structural diagram showing an outside of a front portion of an underwear for a male according to an embodiment of the present application.

Referring to FIGS. 1 and 2, a sewing opening 10 is provided in the front portion 101, and a first isolation layer 3 and a second isolation layer 4 is sewn at the edges of the sewing opening 10. The first isolation layer 3 is provided at an inner side of the body 1, and the second isolation layer 4 is provided at an outer side of the body 1. Top edges of the first isolation layer 3 and the second isolation layer 4 are sewn at a joint of the waist 2 and the body 1. The bottom edges of the first isolation layer 3 and the second isolation layer 4 are sewn at a joint of the front portion 101 and the crotch 103.

Referring to FIGS. 1 and 2, a first opening 5 for a penis to pass through is provided between the first isolation layer 3 and the front portion 101, and a second opening 6 for the penis to pass through is provided between the second isolation layer 4 and the front portion 101. The first opening 5 and the second opening 6 are respectively provided at slightly left and right sides of the body 1, and an outlet passage for a penis to pass through is provided between the first isolation layer 3 and the second isolation layer 4. A user can move his penis outside of the underwear through the first opening 5, the outlet passage and the second opening 6 to urinate.

Referring to FIG. 1, a genital bag 7 is formed, for example, sewn, in the body 1. The genital bag 7 includes a first portion 71 and a second portion 72. The first portion 71 and the second portion 72 are respectively provided at left and right sides of the first isolation layer 3, and the first portion 71 and the second portion 72 covers a part of the first isolation layer 3. A U-shaped opening is formed between the first portion 71 and the second portion 72. An accommodation pocket 8 formed by the first portion 71, the second portion 72 and the first isolation layer 3 together is communicated with the outside via the first opening 5, the second opening 6 and the outlet passage, so as to facilitate urinating.

Referring to FIG. 1, the first portion 71 and the second portion 72 extend along a length direction (a downward direction in FIG. 1) of the body 1. An edge of the first portion 71 along its own extension direction is sewn with the first isolation layer 3 at a position where the first isolation layer 3 and the front portion 101 are sewn together. The top edges of the first portion 71 and the second portion 72 are sewn at a joint of the waist 2 and the body 1, and the bottom edges of the first portion 71 and the bottom of the second portion 72 are formed integrally.

Figure 3:
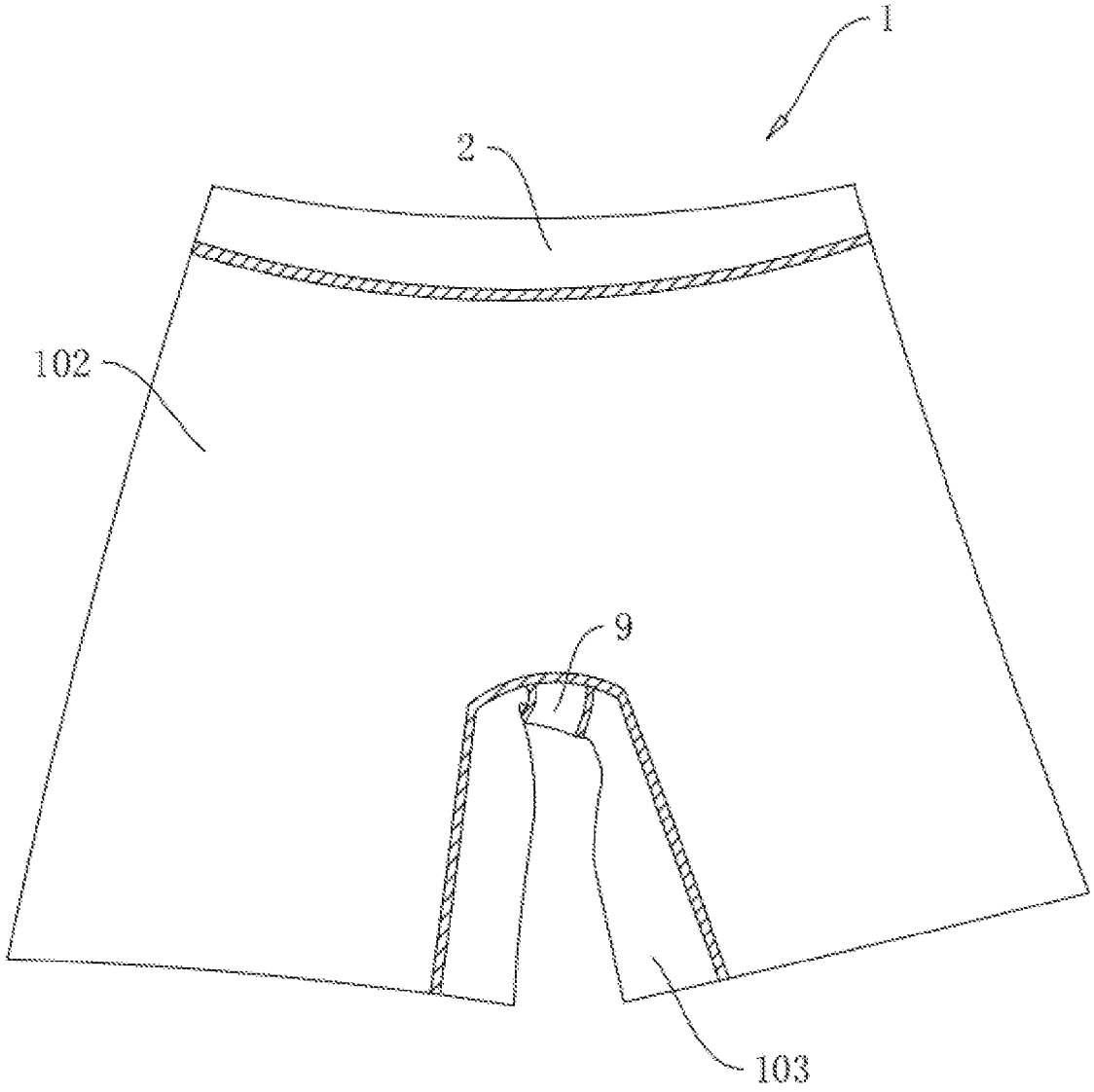
FIG. 3 is a structural diagram showing an inner side of a back portion of an underwear for a male after being turned inside-out according to an embodiment of the present application.

Referring to FIGS. 1 and 3, a connecting part 9 is provided at an inner side of the body 1, which extends from the front portion 101 to the back portion 102. An end of the connecting part 9 close to the front portion 101 is integrated with the bottom edges of the first portion 71 and the second portion 72, that is, the end of the connecting part 9 close to the front portion 101 is integrated with at the lowest edge of the U-shaped opening of the genital bag 7. The other end of the connecting part 9 is sewn at a joint of the back portion 102 and the crotch 103. A gap is formed between the connecting part 9 and the crotch 103. The connecting part 9 is roughly trapezoid, and the end close to the back portion 102 is shorter than the end close to the front portion 101.

Figure 4:
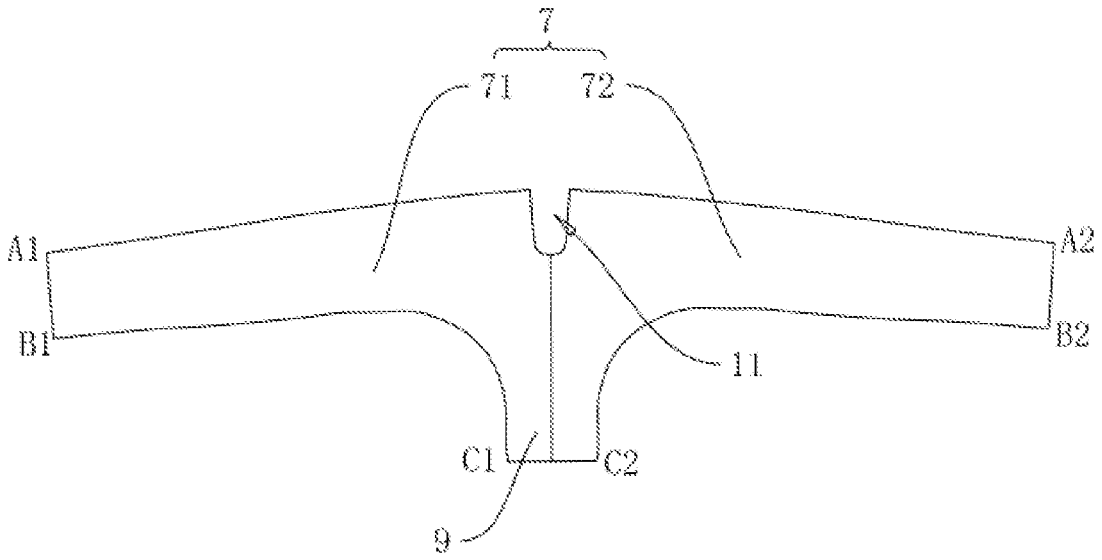
FIG. 4 is a structural diagram of the connecting part, the first layer and the second layer as a whole after being spread in a plane.

Referring to FIG. 4, the connecting part 9 is integrated with the genital bag 7. In a planar view, the connecting part 9 extends along a first direction. The first portion 71 and the second portion 72 extend along a second direction which is roughly perpendicular to the first direction, and symmetrically provided at two sides of the connecting part 9. A notch 11 is provided at a joint of the first portion 71 and the second portion 72, opposite to the connecting part 9. Edges of the first portion 71 and the second portion 72 away from the connecting part 9 along the second direction and those away from the connecting part 9 along the first direction are connected with the body 1 after folding the first portion 71 and the second portion 72 away from the connecting part 9 along the first direction and toward the connecting part 9 along the second direction.

Referring to both FIGS. 1 and 4, the edge A1-B1 of the first portion 71 and the edge A2-B2 of the second portion 72 in FIG. 4, after being folded up, are sewn at the joint of the waist 2 and the front portion 101. The edge C1-C2 of the connecting part 9 is sewn at the joint of the crotch 103 and the back portion 1012. The positions of A1, A2, B1, B2, C1, and C2 correspond to the positions of A1, A2, B1, B2, C1, and C2 in FIG. 1, respectively.

Referring to FIG. 1, assuming that a natural extension length of the connecting part 9 is L1 and a fabric length of the body 1 between two ends of the connecting part 9 is L2, L1 is smaller than L2. In some embodiments, L1 is 0.7 times L2. Thus, when wearing the underwear, the first portion 71 and second portion 72 of the genital bag 7 slightly pull upward the connecting part 9, so that a ventilation channel is formed between the connecting part 9 and the crotch 103. Meanwhile, as the first portion 71 and the second portion 72 pull the connecting part 9 upward, the fabric at the opening of the genital bag 7 is slightly pulled upward.

In some embodiments, the connecting part 9 and the genital bag 7 are made of an elastic cloth. A plurality of air holes are provided in the connecting part 9 and the genital bag 7.

The implementation principle of an underwear for a male according to the application is as follows. When wearing the underwear, a user puts his genital into the genital bag 7, so that the genital bag 7 wraps the scrotum completely, and isolates the scrotum from the skin on the inner thigh. Meanwhile, the genital bag 7 is tightened with the connecting part 9, so that the fabric at the opening of the genital bag 7 is pulled upward, so as to prevent the scrotum from falling off the genital bag 7 and avoid a friction between the skin of the scrotum and the skin on an inner thigh, providing the user with comfortable wearing. Meanwhile, the ventilation channel is formed between the connecting part 9 and the crotch 103, so as to improve air and moisture permeability.

In some embodiments, the body 1 is formed by a front portion 101 and a back portion 102 connected, for example, sewn, with each other. In some embodiments, an end of the connecting part 9 away from the genital bag 7 is sewn at a joint of the front portion 101 and the back portion 102.

In some embodiments, L1 is 0.8 times L2.

In some embodiments, L1 is 0.95 times L2.

In some embodiments, the underwear is briefs.

The described above are the preferred embodiments of the present application, and do not limit the protection scope of the present application. Therefore, all equivalent changes made according to the structure, shape and principle of the present application shall be covered by the protection scope of the present application.

What is claimed is:

1. An underwear for a male comprising:

a body comprising a front portion and a back portion, wherein:

the front portion is provided with a genital bag with an opening, the genital bag is provided at an inner side of the body, a connecting part connected at an edge of the genital bag to the inner side of the body, the connecting part extends from the front portion to the back portion, a first isolation layer is provided at the inner side of the body and connected with the front portion, the genital bag comprises a first portion and a second portion respectively provided at a left side and a right side of the first isolation layer, and an accommodation pocket for accommodating a genital is formed by the first portion, the second portion and the first isolation layer together.

2. The underwear for the male according to claim 1, wherein an end of the connecting part away from the genital bag extends to a joint of the front portion and the back portion.

3. The underwear for the male according to claim 1, wherein the first portion is integrated with the second portion.

4. The underwear for the male according to claim 1, wherein a length of the connecting part is smaller than a fabric length of the body between two ends of the connecting part in an extending direction thereof.

5. The underwear for the male according to claim 4, wherein the length of the connecting part is 0.7-0.95 times the fabric length of the body between the two ends of the connecting part in the extending direction thereof.

6. The underwear for the male according to claim 1, wherein the connecting part is integrated with the genital bag.

7. The underwear for the male according to claim 1, wherein at least one of the genital bag or the connecting part is provided with a plurality of air holes.

8. The underwear for the male according to claim 1, wherein at least one of the genital bag or the connecting part is made of elastic fabric.

9. The underwear for the male according to claim 1, wherein the body further comprises a crotch connected with the front portion and the back portion, and an end of the connecting part away from the genital bag is connected with the crotch.

10. The underwear for the male according to claim 9, wherein the end of the connecting part away from the genital bag is connected with a joint of the back portion and the crotch.

11. The underwear for the male according to claim 1, wherein the front portion is provided with a sewing opening, the first isolation layer is provided at the sewing opening, a first opening is provided between the first isolation layer and the front portion, a second isolation layer is provided at the sewing opening, a second opening is provided between the second isolation layer and the front portion, an outlet passage is provided between the first isolation layer and the second isolation layer, and the accommodation pocket is in communication with an outside via the first opening, the second opening and the outlet passage.

12. The underwear for the male according to claim 6, wherein the connecting part extends along a first direction, the first portion and the second portion extend along a second direction perpendicular to the first direction and symmetrically provided at two sides of the connecting part, a notch is provided at a joint of the first portion and the second portion, opposite to the connecting part, and edges of the first portion and the second portion away from the connecting part along the second direction and edges of the first portion and the second portion away from the connecting part along the first direction are connected with the body after folding the first portion and the second portion away from the connecting part along the first direction and toward the connecting part along the second direction.

* * * * *